United States Patent [19]

Place

[11] 4,297,668

[45] Oct. 27, 1981

[54] THERMOSTAT WITH BRACKET FOR ATTACHMENT TO A TUBULAR MEMBER

[75] Inventor: Donald E. Place, Mansfield, Ohio

[73] Assignee: Therm-O-Disc, Incorporated, Mansfield, Ohio

[21] Appl. No.: 121,138

[22] Filed: Feb. 13, 1980

[51] Int. Cl.[3] ..... H01H 37/04

[52] U.S. Cl. ..... 337/365; 248/226.4; 248/229; 248/231; 337/377; 337/380

[58] Field of Search ..... 337/365, 380, 381, 398, 337/377; 211/26; 248/226.4, 229, 230, 231

[56] References Cited

U.S. PATENT DOCUMENTS

| | | | |
|---|---|---|---|
| 1,268,622 | 6/1918 | Reynolds | 248/229 |
| 1,301,011 | 4/1919 | Scootten | 337/398 |
| 2,191,782 | 2/1940 | Valane | 248/229 |
| 2,273,381 | 2/1942 | Shaw | 337/380 |
| 2,349,126 | 5/1944 | Abernathy | 313/212 |
| 2,369,364 | 2/1945 | Mayer | 224/276 |
| 2,375,870 | 5/1945 | Ray | 237/8 C |
| 2,622,171 | 12/1952 | Hiltenbrand | 280/797 |
| 2,907,851 | 10/1959 | Moorhead et al. | 337/377 |
| 3,014,105 | 12/1961 | Schmitt | 200/138 |

FOREIGN PATENT DOCUMENTS 2339098 2/1975 Fed. Rep. of Germany ..... 337/381

OTHER PUBLICATIONS

"Thermo-Disc 14T Series Controls" (Undated).

Thermo-Disc Drawing No. B-952-A, "Lead Wire Arrangement for Type 14T Thermostat", dated 9-29-61.

*Primary Examiner*—William H. Beha, Jr.

*Attorney, Agent, or Firm*—Pearne, Gordon, Sessions, McCoy & Granger

[57] ABSTRACT

A thermostat assembly is disclosed which includes a bracket for attaching a thermostat to a tubular member, such as a pipe or tube, so that the thermostat may be reactive to the thermal condition of the tubular member. The bracket includes a longitudinal opening so that the bottom of the thermostat may directly contact the tubular member. The bracket also includes thermostat-retaining portions, each of which preferably includes an inwardly extending tab having a lance on the end to dig into the cement on the top of the thermostat. The bracket also includes clip portions which extend around and attach the bracket to the tubular member.

10 Claims, 6 Drawing Figures

THERMOSTAT WITH BRACKET FOR ATTACHMENT TO A TUBULAR MEMBER

BACKGROUND OF THE INVENTION

This invention relates to a thermal responsive device such as a thermostat or the like, and more particularly to a bracket for attaching such a device to a pipe or other tubular member wherein the heat transfer to and from the device is facilitated.

Temperature-responsive switching devices such as thermostats are used to monitor the thermal condition or temperature at various stations in processes and equipment. In commercial air conditioning and ventilating equipment, refrigeration, heat pumps, freezers, and heating-cooling systems, chemical processes, and the like, these thermostats are often used to monitor the temperture of a tubular member such as a tube or pipe or other conduit, in which the thermostat is usually mounted directly on the tubular member. In mounting the thermostat, the thermal responsive mechanism within the thermostat should be directly adjacent to the surface of the tubular member so that heat transfer between the surface of the tubular member and the thermal responsive mechanism will permit accurate sensing of the thermal condition of the tubular member. It is also desirable that the thermostat be capable of being easily mounted to the tubular member and easily removed, so that the thermostat may be repositioned as necessary and may be mounted and removed during maintenance and repair of the equipment.

While the present invention may be used for various types of thermostats, it is particularly adaptable to thermostats which employ a snap disc to actuate a switch. Such a snap disc operates to ensure that the switch opens and closes with snap action rather than with a slow creep-type movement. In some devices of this type, the disc is formed of bimetal and snaps between two positions of stability in direct response to predetermined changes in temperature. When using this device to sense the thermal condition of a tubular member such as a pipe or other conduit, it is important that the bimetal disc be positioned as close as possible to the surface of the tubular member.

PRIOR ART

Various brackets have been used for mounting disc-type thermostats on tubular members. However, if a conventional disc-type thermostat having a flat bottom is mounted directly against the tubular member, the flat bottom of the thermostat makes only a tangential contact with the round surface of the tubular member, resulting in minimal direct contact between the thermostat and the tubular member, which reduces the capability of heat transfer and accurate thermal sensing. Therefore, the prior art mounting devices for disc-type thermostats have used a specially designed thermostat having a rounded bottom to conform to the exterior surface of the tubular member so that the contact between the thermostat and the tubular member is increased. In addition, the prior art mounting devices have included a specially designed mounting portion which was integrally connected as part of the thermostat by which the thermostat was firmly attached to the tubular member.

These prior art thermostats for mounting on tubular members have required specially designed thermostat bodies having special rounded bottoms and connected mounting portions. Thus, thermostats intended for mounting on tubular members were specially ordered, and standard disc-type thermostats which might be otherwise suitable for use with tubular members were unusable because they were not specially adapted for mounting on the tubular member.

SUMMARY OF THE INVENTION

The bracket which is part of the present invention is designed to eliminate the need for a specially designed thermostat or other thermal responsive device for mounting on a tubular member such as a pipe, tube, or other conduit, so that a standard thermostat may be used on a tubular member to respond to the thermal condition therein. The present invention provides a thermostat assembly for attachment to tubular member which comprises a thermostat having a heat-conductive bottom and containing thermal responsive means therein and means for mounting the thermostat on the tubular member. The means for mounting the thermostat on the tubular member may comprise the bracket according to the present invention which includes a base portion, a pair of thermostat-retaining portions, and a clip portion. The base portion is adjacent to the bottom of the thermostat and is adapted to fit against and extend longitudinally along the tubular member. The base portion has a longitudinal opening therein to permit the bottom of the thermostat to directly contact the tubular member. The pair of thermostat-retaining portions extend from the base portion on either side of the thermostat, and have means for attaching the bracket to the thermostat. Preferably, the attaching means comprise tabs which extend inwardly from the thermostat-retaining portions and which have lances on their inwardly extending ends which engage the cement across the top of the thermostat cup to prevent lateral and rotational movement of the thermostat relative to the bracket. In the preferred design of the tabs, the lances are formed by the intersections of the rim of a circular opening in the thermostat-retaining portion and a pair of cuts extending from the opening with the tab formed therebetween. The clip portion extends from the base portion and is adapted to extend around the tubular member to tightly attach the base portion to the tubular member.

Preferably, the thermal responsive means comprises a snap disc located within the thermostat which is capable of two positions of stability in response to the thermal environment of the disc. The snap disc is contained within the thermostat cup and the top of the cup is sealed and covered with a cement seal. The thermal responsive snap disc is located at the bottom of the cup and is therefore adjacent to the surface of the tubular member that is to be monitored.

OBJECTS OF THE INVENTION

It is an important object of this invention to provide a novel and improved device for mounting a thermal responsive device, such as a thermostat or the like, to a tubular member, such as a tube, pipe, or conduit.

It is another object of this invention to provide a novel and improved bracket for mounting a thermostat to a tubular member such as a pipe or tube or the like, in which the bracket provides a substantial amount of direct contact between the thermostat and the tubular member and in which heat transfer between the tubular member and the thermostat is improved.

Still another object of this invention is to provide a thermostat mounting means which may be used with standard flat-bottom thermostats to avoid the necessity of specially designed rounded-bottom thermostats for tube mounting.

A still further object of the invention is to provide a thermostat assembly which may be easily mounted to a tubular member and which may be easily removed during repair and maintenance of the system containing the tubular member.

Further objects and advanages will appear from the following description and drawings.

DETAILED DESCRIPTION OF THE INVENTION

Figure 1:
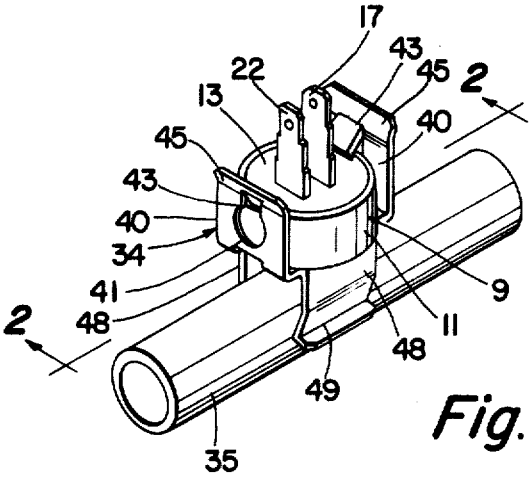
FIG. 1 is a perspective view of the thermostat assembly including the mounting means of the present invention attached to a tubular member.
Figure 2:
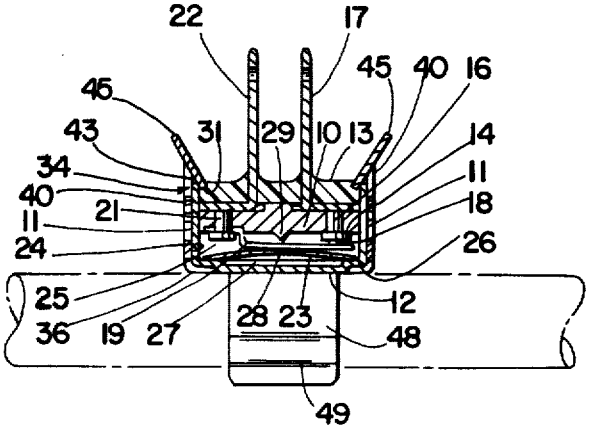
FIG. 2 is a side sectional view of the thermostat assembly taken along line 2—2 of FIG. 1.
Figure 3:
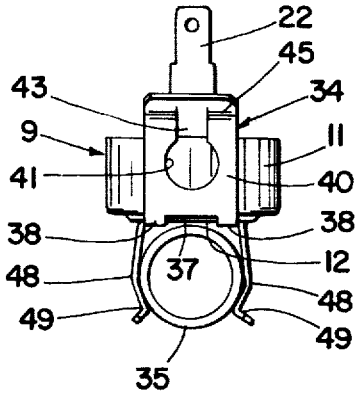
FIG. 3 is an end elevational view of the thermostat, mounting means, and tubular member of FIGS. 1 and 2.

Referring to FIGS. 1-3, the illustrated embodiment of a thermostat assembly incorporating this invention includes a thermostat 9 having a switch body 10 (FIG. 2) positioned within a case or cup 11 (FIGS. 1, 2, and 3) having cylindrical siewalls and a bottom 12 formed of a thermally conductive material such as aluminum, steel or other metal. The body 10 is secured within the cup 11, and the top of the cup 11 is sealed by a layer of cement 13, usually epoxy or the like. As shown in FIG. 2, mounted on the switch body 10 is a fixed contact 14, which in the illustrated embodiment is part of a rivet-type fastener 16. The fastener 16 connects to a first conducting element 17 which is adapted to be connected to an external circuit.

A movable contact 18 is mounted on one end of a spring arm 19 which is secured at its other end to the body 10 by a rivet 21. The rivet 21 connects to a second conducting element 22, which is also adapted to be connected to an external circuit. When the movable contact 18 is in engagement with a fixed contact 14, as illustrated in FIG. 2, electrical continuity is provided between the two conducting elements 17 and 22, and a switch-closed condition exists. When the movable contact 18 moves away from the fixed contact 14, the circuit is opened.

The cup 11 and the switch body 10 cooperate to define a switch cavity 25 in which the contacts 14 and 18 and the spring arm 19 are mounted. Also positioned within the switch cavity 25 is a bimetallic snap disc 23 which is radially located by a cylindrical inner wall 24 provided by the cup 11. The cup 11 is formed with an end wall providing a peripheral shoulder 26 extending inwardly from the cylindrical wall 24 to a centrally located recess 27. The bottom 12 of the cup forms the bottom of the recess 27. The periphery of the snap disc 23 on the side remote from the spring arm 19 engages the shoulder 26 to axially locate the snap disc in the cavity 25, and the recess 27 provides clearance for the central portion of the disc. The spring arm 19 is formed with a projection 28 which engages the central portion of the snap disc 23 on the side opposite the shoulder 26.

The various elements are proportioned so that the movable contact 18 engages the fixed contact 14 when the snap disc 23 is arched toward the switch body 10, as illustrated in FIG. 2, and so that the two contacts 14 and 18 are spaced apart and the switch is open when the snap disc 23 is arched in the opposite direction toward the recess 27. In the switch-open condition, the central portion of the snap disc 23 extends down into the recess 27, but contact is maintained between the projection 28 on the spring arm 19 and the snap disc so that the snap disc is correctly positioned in the cup 11.

The various parts are assembled so that the switch opens and closes with a snap action and so that a bumper 29 formed on the switch body 10 is spaced from the spring arm 19 when the snap disc 23 first snaps to the switch-closed position. The bumper 29, however, serves to limit the deflection of the spring arm 19 so that it is not stressed beyond its elastic limit in the event that the snap disc 23 creeps to a position of greater arch in the direction of the switch body 10.

The illustrated embodiment of this invention is provided with an imperforate case or cup 11 and is arranged so that the switch body 10 is inward of the open end 31 of the cup. Consequently, the epoxy or cement 13 adheres to the wall 24 adjacent to the open end 31 and hermetically seals the entire device, as well as permanently locating the body 10 with respect to the cup 11. The two conducting elements 17 and 22 extend up through the cement 13 so that the cement assists in anchoring the conducting elements to prevent external forces applied to the elements from being transmitted to the switch mechanism. In the illustrated thermostat, the projection 28 directly engages the snap disc 23, so that the cup 11 may in some instances receive an electrical charge. As noted, it is important that the cup 11 be of a heat-conductive material so that thermal energy may be transmitted through the cup to the snap disc 23, and many heat-conductive materials, such as conductive metals, are also electrically conductive materials. If desired, a thin, flexible insulating disc of the type disclosed and claimed in Schmitt U.S. Pat. No. 3,014,105 may be positioned between the projection 28 and the disc 23 so that the cup and disc are electrically insulated from the switch elements.

The illustrated thermostat 9 is essentially the same as the thermostat described in the Schmitt U.S. Pat. No. 3,451,028, and reference may be made to that patent for a further description of its structure and operation. It should be understood that other types of thermostats could be used.

Figure 4:
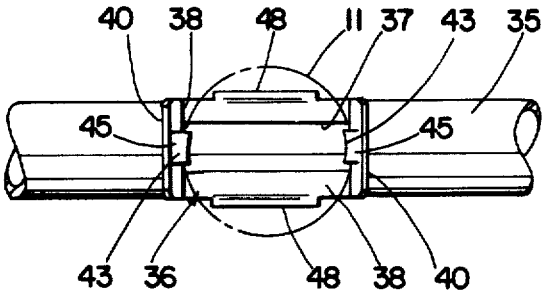
FIG. 4 is a top plan view with the thermostat removed, showing the mounting means attached to the tubular member.

As shown in FIGS. 1-3, the thermostat 9 is retained in a bracket 34 so that it can be mounted on a tubular member 35, such as a pipe, tube, or other conduit which is generally circular in cross section. The bracket 34 has a base portion 36 (FIGS. 2 and 4) which extends longitudinally along the tubular member 35 outside and adjacent to the bottom 12 of the cup 11. As shown in FIG. 4, the base portion 36 has a substantial longitudinal opening or slot 37 extending along its entire length. As a result of the opening 37, the cup bottom 12 is in direct contact with the outside of the tubular member 35 to form a conductive path between the tubular member and the cup 11 for heat transfer. On either side of the opening 37, the base portion 36 is formed of side strips 38 which extend longitudinally along the exterior of the tubular member 35 and provide additional contact with the cup bottom 12 through which thermal conduction may take place. As shown in FIG. 3, the combination of the opening 37 and the two side strips 38 forms a surface which may generally conform to the curved surface of the tubular member 35 but the opening 37 is sufficiently wide to ensure direct contact between the cup bottom 12 and tubular member 35.

Figure 5:
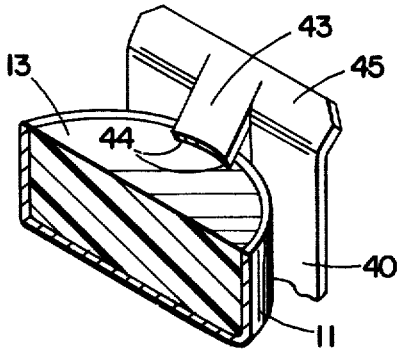
FIG. 5 is a detailed perspective view showing the attachment of the mounting means to the thermostat.
Figure 6:
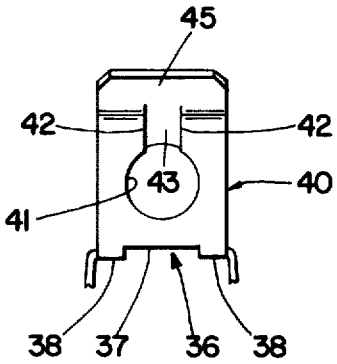
FIG. 6 is an end elevational view similar to FIG. 3 showing one of the thermostat-retaining portions of the mounting means and the formation of the attaching means on the thermostat-retaining portion.

The bracket 34 is attached to the thermostat 9 by a pair of thermostat-retaining portions 40 which extend outwardly from the base portion 36 at each end of the base portion along the sides of the cup 11. As shown in FIG. 6, each thermostat-retaining portion 40 is formed with a central circular opening 41. Two parallel cuts 42 are made in the portion 40 extending outwardly from the circular opening 41 to form a tab 43 which may be separated from the rest of the portion 40. The end of the tab 43 is formed by a segment of the circular opening 41 and is thus curved. As shown in FIG. 5, two lances 44 are formed on the end of the tab 43, one lance being formed at the intersection of the circular opening 41 and each of the cuts 42. The upper end 45 of the thermostat-retaining portion 40 may be bent outwardly so that the tab 43 is also bent to extend inwardly toward the cup 11. In this configuration, the lances 44 at the end of the tab 43 dig into the cement 13 on the upper surface of the thermostat 9, holding the thermostat in place and preventing lateral and rotational movement of the switch elements relative to the bracket 34. Due to the resilient bending connection of the thermostat-retaining portion 40 to the base portion 36 and of the end 45 and the tabs 43 to the portion 40, the tabs 43 are spring-biased and variations in the height of the cement 13 above or below the rim of the cup 11 may be accommodated so that the switch elements will always be firmly retained by the bracket 34 regardless of the variations in the fill of cement 13 and the thermostat is firmly urged into contact with the tubular member 35.

As shown in FIG. 3, the bracket 34 is held to the tubular member 35 by a clipping mechanism comprising a pair of clip portions 48 which extend from each side of the base portion 36 in the direction opposite from the thermostat-retaining portions 40. The ends 49 of the clip portions 48 are bent inwardly to generally conform to the diameter of the tubular member 35 and to be resiliently spring-biased inwardly so that the bracket 34 is held in place on the tubular member 35. The ends 49 are also angled inwardly a sufficient amount so that the bracket is resiliently biased into engagement with the tubular member. The clip portions 48 provide an additional path for heat flow as thermal conduction takes place from between the tubular member 35 and the cup bottom 12 through the two clip portions and the two side strips 38 of the base portion 36. The bracket 34 may be removed from the tubular member 35 by forcing the clip portions 48 apart.

The cup-retaining portions 40 extend from each end of the base portion 36 and the clip portions 48 extend from each side of the base portion, so that the entire bracket 34 may be formed of a single piece of resilient sheet metal material which is stamped out to form the basic bracket configuration, with the longitudinal opening 37 and the circular openings 41 and the cuts 42 for the tabs 43. The cup-retaining portions 40 are the bent upwardly and the ends 45 outwardly to form the inwardly extending, resiliently biased tabs 43, and the clip portions 48 are bent downwardly with the ends 49 bent inwardly to form the spring-biased clipping mechanism. A bracket 34 for the thermostat may thus be conveniently and inexpensively made, and the bracket especially adapted to be connected to a standard thermally reponsive switch or thermostat which is mounted in the cup 11 and sealed with the cement 13. The bracket 34 may be attached to the switch or thermostat as required and mounted on a tubular member 35. The lances 43 serve to hold the bracket 34 securely to the cement 13 in the cup 11. Further, the cup bottom 12 is in direct contact with the outside of the tubular member 35 so that the snap disc 23 is in close proximity to the thermal environment of the tubular member to achieve a more accurate thermal response.

Although a preferred embodiment of this invention is illustrated, it is to be understood that various modifications and rearrangement of parts may be resorted to without departing from the scope of the invention disclosed and claimed herein.

What is claimed is:

1. A thermostat assembly for attachment to a tubular member which comprises a thermostat having a heat-conductive bottom and containing thermal responsive means therein; and means for mounting the thermostat on a tubular member which comprises a base portion adjacent to the bottom of the thermostat and which is adapted to fit against and extend longitudinally along the tubular member and which has a longitudinal opening therein to permit the bottom of the thermostat to directly contact the tubular member, a pair of thermostat-retaining portions which extend from the base portion on either side of the thermostat and which have means for attaching to the thermostat, and a clip portion which extends from the base portion and which is adapted to extend around the tubular member to tightly attach the base portion to the tubular member.

2. A thermostat assembly as set forth in claim 1, wherein the thermal responsive means comprises a snap disc located within the thermostat which is capable of two positions of stability in response to the thermal environment thereof.

3. A thermostat assembly as set forth in claim 2, wherein the snap disc is adjacent to the heat-conductive bottom of the thermostat.

4. A thermostat assembly as set forth in claim 1, wherein the means for attaching comprises a tab which extends from the thermostat-retaining portion and engages part of the thermostat.

5. A thermostat assembly as set forth in claim 4, wherein the thermostat is cup-shaped and has cement across the top of the cup, and the tab has a lance on its inwardly extending end which engages the cement.

6. A thermostat assembly as set forth in claim 5, wherein a pair of lances are formed on the end of the tab.

7. A thermostat assembly as set forth in claim 6, wherein each of the thermostat-retaining portions has a circular opening with a pair of cuts extending from the circular opening and forming a tab therebetween, and the pair of lances are formed on the end of the tab by the intersections of the rim of the circular opening and the pair of cuts.

8. A bracket for attaching a cup-shaped thermostat having a cement top and a heat-conductive bottom to a tubular member, which comprises a base portion which is adapted to be positioned adjacent to the bottom of the thermostat and to fit against and extend longitudinally along the tubular member, the base portion having a longitudinal opening therein to permit the bottom of the thermostat to directly contact the tubular member; a pair of thermostat-retaining portions which extend from the base portion and are adapted to be positioned on either side of the cup, each of the thermostat-retaining portions having an inwardly extending tab having a lance on the end thereof adapted to engage the cement on the top of the thermostat; and a clip portion which extends from the base portion and which is adapted to extend around the tubular member to tightly attach the base portion to the tubular member.

9. A bracket as set forth in claim 8, wherein a pair of lances are formed on the end of the tab.

10. A bracket as set forth in claim 9, wherein each of the thermostat-retaining portions has a circular opening with a pair of cuts extending from the circular opening and forming the tab therebetween, and the pair of lances are formed on the end of the tab by the intersections of the rim of the circular opening and the pair of cuts.

* * * * *